United States Patent [19]

Fleming, Jr. et al.

[11] Patent Number: 4,852,321

[45] Date of Patent: Aug. 1, 1989

[54] TRANSLUCENT END BLOCK

[75] Inventors: Harry A. Fleming, Jr., Smethport; Edward F. Fosnaught; Robert L. Wehman, both of Port Allegany, all of Pa.

[73] Assignee: Pittsburgh Corning Corporation, Pittsburgh, Pa.

[21] Appl. No.: 129,154

[22] Filed: Dec. 7, 1987

[51] Int. Cl.[4] ..... F04C 1/42

[52] U.S. Cl. ..... 52/306; D25/103; D25/108; D25/113

[58] Field of Search ..... 52/306, 307, 308, 604, 52/608, 609; 404/34; D25/103, 107, 108, 109, 113

[56] References Cited

U.S. PATENT DOCUMENTS

| | | | |
|---|---|---|---|
| D. 241,429 | 9/1976 | Gustan et al. | D25/108 |
| 250,635 | 12/1881 | McLean | D25/108 |
| 1,855,987 | 4/1932 | Rammer | D25/113 |
| 2,110,885 | 3/1938 | Lytle | 52/306 |
| 2,322,591 | 6/1943 | Rapp | 52/306 |
| 2,333,723 | 11/1943 | Jordan | 52/306 |
| 2,724,260 | 11/1955 | D'Eustachio | 52/306 |
| 3,798,861 | 3/1974 | Weiss | 52/306 |
| 4,023,319 | 5/1977 | Kurata | 52/306 |
| 4,651,486 | 3/1987 | Erickson et al. | 52/306 |
| 4,719,735 | 1/1988 | Fleming, Jr. et al. | 52/306 |

FOREIGN PATENT DOCUMENTS

| | | | |
|---|---|---|---|
| 848079 | 10/1939 | France | 52/306 |

*Primary Examiner*—Michael Safavi

*Attorney, Agent, or Firm*—Stanley J. Price, Jr.

[57] ABSTRACT

A translucent end block which may be secured to an exposed side or top abutting surface of a translucent block includes a pair of parallel upper and lower surfaces spaced from each other and having generally the same preselected shape. A pair of side walls extend between the upper and lower surfaces and are joined to the upper and lower surfaces. The pair of side walls each have first wall portions positioned in parallel, spaced relation with each other and nonparallel second wall portions. A first end wall is positioned between the pair of side walls first wall portions and is joined to the upper and lower surfaces and to the pair of side walls first wall portions. The end block is secured to an exposed side or top abutting surface of a translucent block which forms a part of a translucent block wall structure to provide a translucent block wall structure having usable top or side surfaces.

5 Claims, 2 Drawing Sheets

TRANSLUCENT END BLOCK

BACKGROUND OF THE INVENTION

1. Field Of The Invention

This invention relates to an end block, and more particularly, to unitary translucent end blocks which may be secured to the exposed top or side abutting surfaces of translucent blocks which form a translucent block wall structure to provide a translucent block wall structure having usable top or side surfaces.

2. Description Of The Prior Art

The use of translucent block, such as glass block, for exterior and interior applications is well known. Using glass block for wall structures offers various aesthetic and design possibilities, as well as provides various functional characteristics and advantages over other materials which may be used for similar purposes. For example, glass block structures promote energy conservation through their insulating capability to reduce heat gain or loss and to provide thermal efficiencies for energy conservation. In addition, glass block structures can control light transmission and glare, as well as reduce surface condensation, draft and noise transmission. Because of their construction, glass block structures offer security advantages while maintaining light transmission therethrough. Lastly, glass block structures have the added advantage of easy maintenance and installation.

Although translucent blocks may be utilized with excellent results to form various wall structures, it is often desired to form a translucent block wall structure which is used as a room or office divider or other wall structure which does not extend vertically from floor to ceiling. Typically, translucent block wall structures which form room or office dividers are between four and six courses of block in height. Similarly, translucent block wall structures may include passageways to permit pedestrian travel between partitioned room or office sections.

As is known in the art, each individual block in the wall structure normally includes two abutting side surfaces, and a top and bottom abutting surface positioned between the opposed, outer block faces. Each glass block abutting surface includes two surfaces each tapered inwardly from an outside edge of the glass block to meet at the center of the abutting surface.

As a result, if it is desired to form a translucent block wall structure to serve as a room or office divider which does not extend completely from floor to ceiling, the top surface of the translucent block divider structure, which is composed of a plurality of glass block abutting top surfaces, has a generally inwardly tapered configuration. Similarly, a pedestrian passageway formed in the block wall structure has a vertically extending side surface composed of a plurality of stacked, vertically extending glass block abutting side surfaces each having the same generally inwardly tapered configuration.

Normally, the exposed top or side surface of the block wall structure is covered with either a finished wood or metallic sheet material to provide top and side surfaces, respectively, which may be usable for other purposes. For example, the exposed top surface of the block wall structure may be covered with a wood or decorative sheet material to provide a generally flat divider top surface which may be used as a shelf or for other suitable purposes. The pedestrian passageway vertically extending side surface may also be covered with wood or sheet material to provide a generally flat vertical side surface for use with a room divider door.

Although wood or decorative metallic sheet material may be used to cover the exposed top or side abutting surfaces of a translucent block wall structure, these various coverings are difficult to secure to the exposed block abutting surfaces and detract from the otherwise generally aesthetically pleasing appearance of the block wall structure.

The block wall structures heretofore formed from a plurality of individual translucent blocks each include exposed top or side wall surfaces which must be finished if it is desired to provide usable top or side wall surfaces.

U.S. Pat. No. 1,425,102 discloses a wall structure made from glass blocks in which the individual glass blocks are assembled together into a permanent wall structure with the weight of the structure being supported by a plastic or reinforced concrete grid. However, since each block includes a pair of peripheral ribs which extend outwardly beyond the peripheral edges of the glass plates making up the block faces, the exposed top and side surfaces of the block wall structure must be either filled in with cement or covered over with a finished wood or metallic sheet material to provide top and side surfaces, respectively, which may be usable for other purposes.

U.S. Pat. No. 1,994,387 discloses a hollow unit made from glass or other transparent material for use in the construction of a wall. Each of the hollow units has an upper assembling face with one or more tenons positioned thereon. The tenons are engaged by an upper hollow unit, and a groove positioned on each tenon is adapted to form a space within the interior of the upper unit in which cement may be dispersed to prevent the cement from rising into the interior of the upper unit above the tenon. However, wall structures made from these hollow units have, on the exposed upper exposed surface of the structure, a plurality of tenons which project upwardly from the top surfaces of the units. These upwardly projecting tenons prevent the exposed top surface of the wall structure from being used for any other purpose.

U.S. Pat. No. 2,086,185 discloses a hollow glass block having a pair opposing, hexagonal side faces. The glass blocks may be assembled to form a wall structure. However, because of the hexagonal shape of the blocks, if it is desired to form a wall structure having an exposed top surface, every other block in the top layer must be cut in half to provide a substantially level top surface. Since the blocks are hollow, the exposed top surface must be covered to provide a top surface which may be usable for other purposes. In addition, a block wall structure made from these blocks and having an exposed side surface requires each block lying along the exposed side surface to be cut in half. Therefore, if it is desired to provide a block wall structure having a usable side surface, the hollow interiors of the glass blocks forming the exposed side surface must also be covered over.

U.S. Pat. No. 2,110,885 discloses a wall structure made from glass bricks positioned in abutting relation at their edges. The edges of each brick are coated with a layer of polymerized vinyl resin to provide an adequate mortar adhering surface between opposing pairs of coated edges.

U.S. Pat. No. 2,110,900 discloses a hollow building block composed of several sections united to provide that the parting line between the sections will be disposed between exposed faces of the block. When the blocks are used to form a wall structure, the parting line or joint between the sections of each building block are protected and strengthened by the mortar or other medium employed in joining the blocks together.

U.S. Pat. No. 2,115,513 discloses a hollow glass block made from two rectangular cup-like sections which may be united by glass-to-glass contact effected while the glass is in a semi-plastic state, or by a film or sheet of aluminum or other suitable metal interposed between the two rectangular cup-like sections. Since the exterior surface of the block is smooth, the exposed mortar bearing surfaces of the block are coated with a gritty material to create an effective mortar bearing surface when the blocks are assembled into a wall structure.

U.S. Pat. No. 2,306,320 discloses a glass block which may be used in the assembly of panels suitable for use in relatively horizontally positioned structures, such as roofs, floors, canopies and the like. The glass blocks each have edges formed to facilitate the arrangement of the glass blocks in a deck structure with a supporting grid of reinforced grout enclosing the blocks and maintaining them in position. In this manner, the glass blocks may be assembled other than vertically, and the edges of the glass blocks support the glass blocks in a horizontal position.

U.S. Pat. No. 3,798,861 discloses a wall construction module for use in assembling building partitions. Each module is injection-molded from translucent colored plastic in the form of two hollow sections which are welded into a closed unit. Each module is contoured for interlocking engagement with a pair of uprights and for interfitting engagement with adjacent modules above and below in the partition assembly.

U.S. Pat. No. 4,023,319 discloses a curtain wall assembly made of interfitting glass blocks. Each glass block has at least top and bottom surfaces contoured for interfitting engagement with similar faces of upper and lower blocks. The opposite lateral faces of each block may also be contoured for interengagement with similar lateral faces of the blocks on both sides. Vertical bracing units may be used if desired to increase the stability of the glass block.

U.S. Pat. No. 4,651,486 disclosed a translucent block for use in wall and column structures. The block includes a pair of parallel upper and lower faces each having a generally irregular hexagonal shape. The block includes a first and second pair of generally rectangular opposing ends which are joined to the upper and lower faces. The block further includes a pair of generally rectangular opposing sides which are parallel with each other and are also joined to the upper and lower faces. The translucent block can be joined to similar translucent blocks and/or different translucent blocks to form a wide variety of wall and column structures.

While it has been suggested by the prior art to use translucent blocks to form various wall structures, there remains a need for a translucent end block which may be conveniently secured to an exposed top or side abutting surface of a translucent block to provide a wall structure in which the exposed top or side surface of the wall structure does not require wood or similar coverings to form usable top or side surfaces. The translucent end block is preferably formed from the same translucent material as the translucent block and has the same decorative design as the translucent block.

SUMMARY OF THE INVENTION

In accordance with the present invention, there is provided a translucent end block which includes a pair of substantially parallel upper and lower surfaces spaced from each other. The upper and lower surfaces each have generally the same configuration. A pair of side walls are provided which are perpendicular and joined to the upper and lower surfaces. The pair of side walls have first wall portions positioned in parallel, spaced relation with each other and nonparallel second wall portions. One of the nonparallel second wall portions extends from and is integral with one of the pair of first wall portions. A first end wall is positioned between the pair of side walls first wall portions and is joined to the upper and lower surfaces and to the pair of side walls first wall portions. The first end wall is perpendicular to the substantially parallel upper and lower surfaces.

Accordingly, the principal object of the present invention is to provide a translucent end block which may be conveniently secured to an exposed top or side abutting surface of a translucent block which forms a part of a block wall structure.

An additional object of the present invention is to provide a translucent end block formed from parallel upper and lower surfaces each generally having the same peripheral configuration and connected by means of a plurality of side walls in which the contour of the side walls is substantially identical to the peripheral configuration of the parallel upper and lower surfaces.

Another object of the present invention is to provide a translucent end block which may be secured to an exposed top or side abutting surface of a translucent block which forms a part of a translucent block wall structure to provide a translucent block wall structure having usable top and side surfaces.

These and other objects of the present invention will be more completely disclosed and described in the following specification, the accompanying drawings and the appended claims.

DESCRIPTION OF THE PREFERRED EMBODIMENTS

Figure 1:
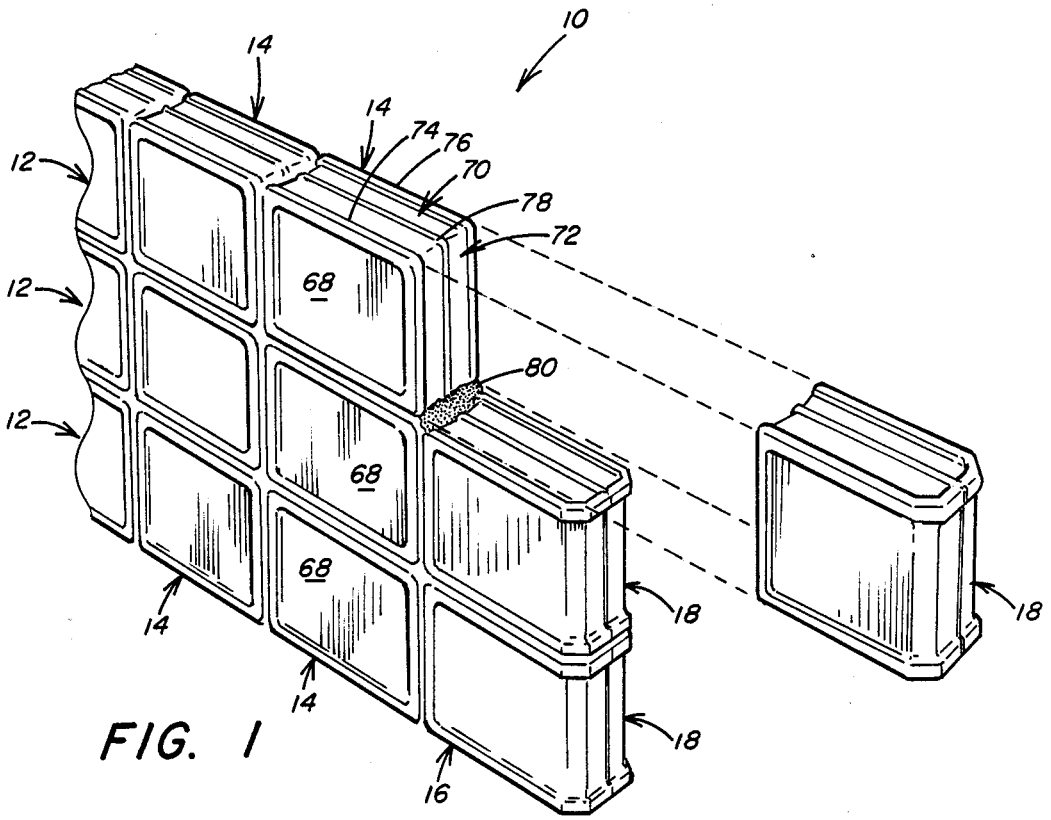
FIG. 1 is a perspective view of a portion of a translucent block wall structure including end blocks which are the subject of this invention.

Referring to the drawings, and particularly to FIG. 1, there is illustrated a portion of a translucent block wall structure 10, such as a glass block wall structure, having at least one layer of translucent block. The layers of translucent block are generally designated by the numeral 12. The translucent block wall layers 12 each include a plurality of conventional glass blocks 14. The glass blocks 14 are themselves known in the art, and are described herein only as they relate to the present invention. The translucent glass block wall structure 10 also includes an end block section 16 joined with the conventional glass blocks 14. Although end block section 16 is joined with the straight translucent block wall section, end block section 16 is shown partially detached from the straight translucent block wall section in FIG. 1 to better illustrate end block section 16.

Figure 2:
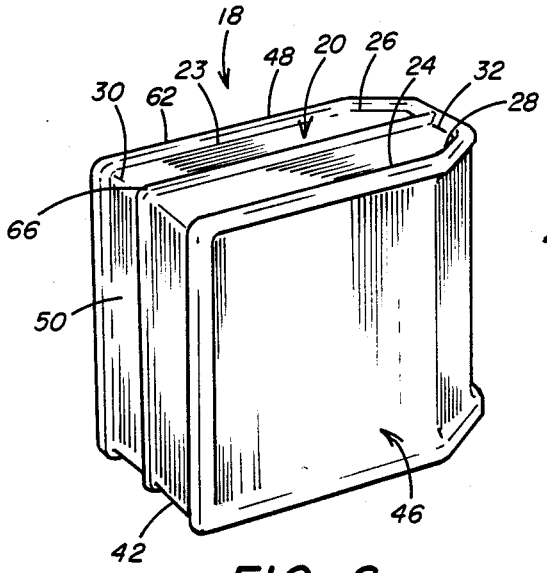
FIG. 2 is perspective view of a translucent end block which is the subject of the present invention.

To form end block section 16, the translucent block wall structure 10 includes a plurality of translucent end blocks 18. An end block 18 is illustrated in greater detail in FIGS. 2 and 3. FIG. 2 is a perspective view of an end block 18, and FIG. 3 is a perspective view of the end block 18 shown in FIG. 2 inverted to illustrate the end block lower surface.

Translucent end block 18 has an upper surface generally designated by the numeral 20 and a lower surface generally designated by the numeral 22. As seen in FIG. 2, upper surface 20 has a pair of side edge portions 23 and 24 which are substantially parallel with each other and have the same length. Upper surface 20 also includes a pair of nonparallel side edge portions 26 and 28. As seen in FIG. 2, side edge portion 26 is integral with and extends from side edge portion 23. In addition, side edge portion 26 is angularly spaced from side edge portion 23 by a preselected angle. Side edge portion 28, which is integral with and extends from side edge portion 24, is angularly spaced from side edge portion 24 by the same preselected angle. Upper surface 20 also includes a rear edge portion 30 which extends between the pair of side edge portions 23, 24 and a front edge portion 32 which extends between the pair of nonparallel side edge portions 26 and 28.

Figure 3:
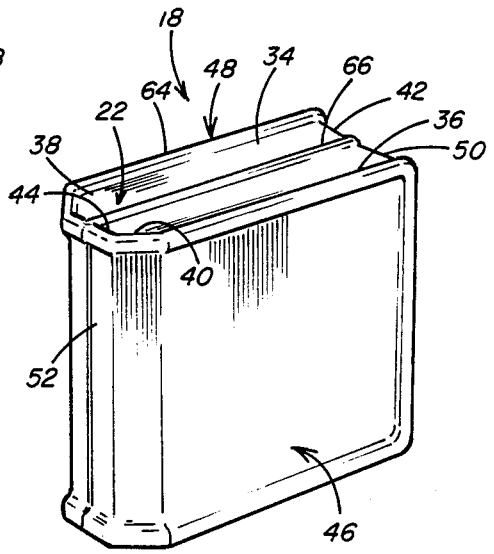
FIG. 3 is a perspective view of the translucent end block illustrated in FIG. 2, with the translucent end block of FIG. 2 inverted to illustrate the lower surface of the end block.

As seen in FIG. 3, end block 18 lower surface 22 has a pair of side edge portions 34 and 36 which are substantially parallel with each other and also have the same length. Lower surface 22 also includes a pair of nonparallel side edge portions 38 and 40. As seen in FIG. 3, side edge portion 38 is integral with and extends from side edge portion 34. In addition, side edge portion 38 is angularly spaced from side edge portion 34 by a preselected angle. Side edge portion 40, which is integral with and extends from side edge portion 36, is angularly spaced from side edge portion 36 by the same preselected angle. Lower surface 22 also includes a rear edge portion 42 which extends between the pair of side edge portions 34, 36, and a front edge portion 44 which extends between the pair of nonparallel side edge portions 38, 40.

As seen in FIGS. 2 and 3, nonparallel side edge portions 26, 28, 38 and 40 are angularly spaced from side edge portions 23, 24, 34 and 36, respectively by the same preselected angle. In addition, the rear edge portion 30 of upper surface 20 is substantially parallel with front edge portion 32, and the rear edge portion 42 of lower surface 22 is substantially parallel with front edge portion 44. As described, upper and lower surfaces 20, 22 have generally the same configuration.

End block 18 also includes two side walls generally designated by the numerals 46, 48 which extend between upper and lower surfaces 20, 22. Side walls 46, 48 are perpendicular and integral with upper surface 20 and lower surface 22. The end block 18 further includes a first or rear end wall 50 and a second or front end wall 52 which are perpendicular and integral with upper surface 20 and lower 22.

As seen in FIGS. 2 through 5, the pair of side walls 46, 48 include first wall portions 54, 56 which are parallel and spaced from each other. First wall portion 54 extends between upper surface 20 side edge portion 24 and lower surface 22 side edge portion 36. First wall portion 56 extends between upper surface 20 side edge portion 23 and lower surface 22 side edge portion 34. The pair of side walls 46, 48 also include nonparallel second wall portions 58, 60. Nonparallel second wall portion 58 extends between upper surface 20 nonparallel side edge portion 28 and lower surface 22 nonparallel side edge portion 40. Nonparallel second wall portion 60 extends between upper surface 20 nonparallel side edge portion 26 and lower surface 22 nonparallel side edge portion 38. As seen in the Figures, nonparallel second wall portions 58, 60 are integral with and extend from first wall portions 54, 56 respectively. In addition, nonparallel second wall portions respectively by the same preselected angle by which nonparallel side edge portions 26, 28, 38 and 40 are angularly spaced from side edge portions 23, 24, 34 and 36 respectively.

As seen in FIG. 2, end block 18 first or rear end wall 50 has a generally rectangular configuration, and is perpendicular and joined with upper surface 20 at rear edge surface 30 and lower surface 22 at rear edge surface 42. First or rear end wall 50 is positioned between the pair of parallel side wall first wall portions 54, 56 and is integral with first wall portions 54, 56.

As seen in FIG. 3, the end block 18 may also include, if desired, a second or front end wall 52 of generally rectangular configuration which is perpendicular and joined with upper surface 20 at front edge surface 32 and lower surface 22 at front edge surface 44. A illustrated in FIG. 4, second or front end wall 52 is integral with the pair of side wall nonparallel second wall portions 58, 60. In addition, front end wall 52 and rear end wall 50 are positioned in substantially parallel, opposed relation with each other.

Referring to FIG. 2, end block 18 upper surface 20 may include, if desired, a raised surface portion 62 which extends around a portion of the perimeter of upper surface 20. As seen in FIG. 3, end block 18 lower surface 22 may also include, if desired, a raised surface portion 64 which extends around a portion of the perimeter of lower surface 22. As will be explained later in greater detail, the raised surface portions 62 and 64 may be formed on end block 18 to provide additional mortar-adhering surfaces between adjacent end blocks 18 when the end blocks 18 are joined to a column of translucent blocks such as shown in FIG. 1.

Figure 4:
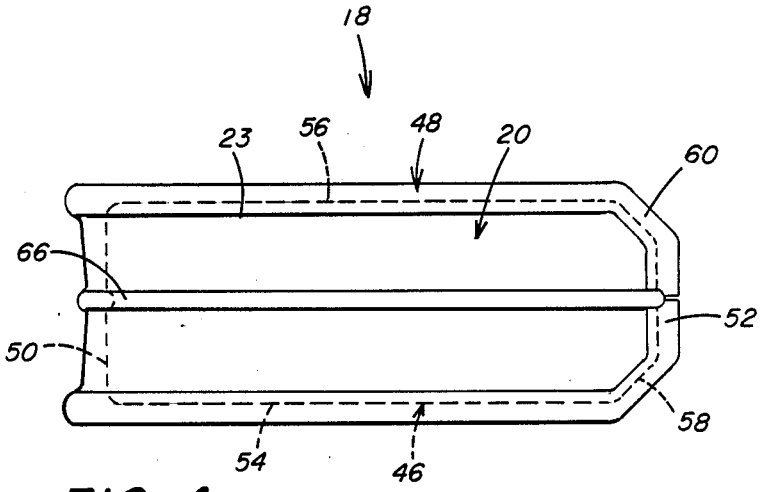
FIG. 4 is a top plan view of a translucent end block.
Figure 5:
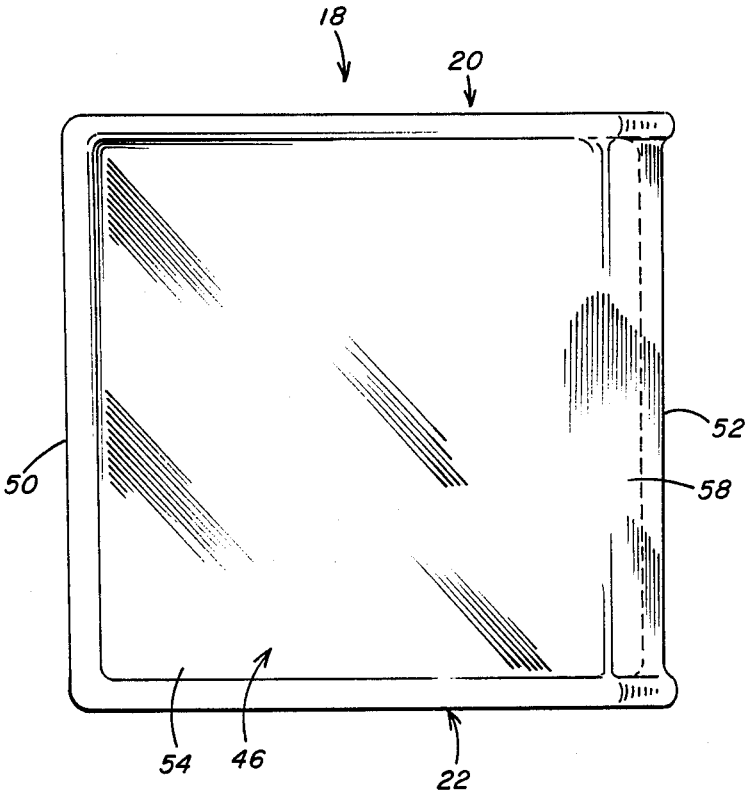
FIG. 5 is a side elevational view of the translucent end block illustrated in FIG. 4.

As previously described and illustrated in FIG. 4, nonparallel second wall portion 58 is integral with first wall portion 54 on end block 18. Similarly, nonparallel second wall portion 60 is integral with first wall portion 56. Since nonparallel second wall portion 58 is connected between upper and lower surfaces 20, 22 nonparallel side edge portions 28, 40 and nonparallel second wall portion 60 is connected between upper and lower surfaces 20, 22 nonparallel side edge portions 26, 38, the adjacent side wall portions 54, 58 and the adjacent side wall portions 56, 60 respectively meet to form angles between these adjacent side walls. As previously described, the angles between side wall portions 56, 60 and side wall portions 54, 58 are equal, preselected angles. The angles between adjacent side wall portions 56, 60 and side wall portions 54, 58 are each greater than 90°. The angles between adjacent side wall portions 56, 60 and adjacent side wall portions 54, 58 may be selected so that the nonparallel side wall portions 58, 60 of end block 18 are positioned in either converging or diverging relation with each other.

If it is desired to form an end block 18 having a front or second end wall 52, front end wall 52 is positioned between and integral with nonparallel second wall portions 58, 60. Since nonparallel second wall portions 58, 60 are connected between the nonparallel edge surface portions of upper and lower surfaces 20, 22, front end wall 52 is angularly spaced from nonparallel second wall portions 58, 60. The angle between nonparallel second wall portion 58 and front end wall 52, and the angle between nonparallel second wall portion 60 and front end wall 52 are preferably equal angles. The angle between nonparallel second wall portion 58 and front end wall 52, and the angle between nonparallel second wall portion 60 and front end wall 52 may each be varied depending upon the angle between adjacent side wall portions 54, 58 and 56, 60 to provide that front end wall 52 remains substantially parallel with rear end wall 50.

End block 18 may be composed of any suitable translucent material, such as a suitable glass material, and can be formed by any conventional glass forming process known in the art. End block 18 is desirably a hollow glass block and is preferably formed from pressing two halves of glass block together under appropriate temperature and pressure conditions using known conventional processes and apparatus. Although not shown to include the wide variety of possible designs in the Figures, the forming process usually includes providing the interior surfaces of the side wall portions 54, 56, 58, 60 and front end wall 52 with some type of molded decorative design which is clearly visible through the glass material after the halves of the end block 18 are joined. The location of the fusion of the two pressed halves of block forming the unitary end block 18 is indicated by the numeral 66 in FIGS. 2–4. Each of the halves of the end block 8 are identical and include one of the parallel side wall portions 54, 56, one of the nonparallel side wall portions 58, 60, half of the rear and front end walls 50, 52, and half of the upper and lower surfaces 20, 22.

Referring to FIG. 1, there is illustrated the wall structure previously described, formed from a plurality of conventional glass blocks 14 and a plurality of end blocks 18. As seen in FIG. 1, each glass block 14 includes a pair of opposing side faces (one shown at 68), an abutting top surface 70 and an abutting side surface 72. Although not shown, each glass block 14 also includes an abutting bottom surface and an additional abutting side surface between the pair of opposing side faces. Each glass block 14 further includes a pair of raised edge surfaces 74, 76 which extend around the perimeter of the opposing side faces and a raised surface portion 78 which is formed during the glass block 14 forming process. As further seen in FIG. 1, the overall width of end block 18 substantially equals the overall width of glass block 14, and the overall length and height of end block 18 substantially equal the overall length and height of glass block 14.

In order to form the translucent block wall structure 10 which includes a plurality of layers 12 of translucent block 14 and a translucent end block section 16, each end block 18 in end block section 16 is positioned in relation to a vertically adjacent glass block 14 as shown in FIG. 1. Each end block 18 is joined to an adjacent glass block 14 by a suitable bonding material 80. Many types of commercially available bonding materials can be utilized with the present invention, such as a conventional cementitious material or mortar. The bonding material can also include a water proofing constituent if desired. As seen in FIG. 1, the mortar or other suitable bonding material is laid up between the abutting side surfaces 72 of the glass blocks 14 and the first or rear end walls 50 of end blocks 18 to permanently bond each end block 18 to an adjacent glass block 14. In addition, mortar or other suitable bonding material is also laid up between the upper surface 20 of one of the end blocks 18 in end block section 16 and the lower surface 22 of an end block 18 positioned above the lower end block 18. In this manner, the mortar or other suitable bonding material permanently bonds the plurality of end blocks 18 to the plurality of adjacent glass blocks 14, and also bonds the plurality of end blocks 18 together to form the glass block wall structure 10 illustrated in FIG. 1. As previously described, the raised surface portions 62, 64 formed on the upper and lower surfaces 20, 22 respectively, of each end block 18 provide additional mortar-adhering surfaces between adjacent end blocks 18 in end block section 16.

The end block 18 illustrated in the Figures and described herein provides a usable vertical surface for the translucent block wall structure 10 illustrated in FIG. 1. The usable vertical surface is formed from the plurality of vertically stacked end blocks 18 front or second end walls 52 and nonparallel second wall portions 58, 60. Although not specifically illustrated in FIG. 1, it should be understood that an end block 18 may also be secured to the exposed top abutting surface 70 of each glass block 14 in the top layer 12 of wall structure 10 to form a usable top layer 12 top surface.

It should further be understood that although an end block 18 having a specific configuration is described herein, an end block 18 having any predetermined configuration may be utilized without departing from this invention. As previously described, the nonparallel second wall portions 58, 60 of end block 18 may be positioned in either converging or diverging relation relative to each other. In addition, end block 18 may have any desired ornamental aesthetic external appearance.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described herein.

We claim:

1. A translucent glass end block comprising, a pair of substantially parallel planar upper and lower mortar receiving surfaces spaced from each other, each of said surfaces having an outwardly extending mortar retaining bead portion, a pair of side walls which are perpendicular and joined to said upper and lower mortar receiving surfaces, said side walls having decorative exposed surfaces, each of said side walls having first wall portions positioned in parallel, spaced relation with each other and nonparallel second wall portions, each of said nonparallel second wall portions extending from and integral with one of said first wall portions, said nonparallel second wall portions converging toward each other, a rear mortar receiving end wall positioned between and joined to said pair of side wall first wall portions and to said upper and lower surfaces, said rear end wall having an outwardly extending mortar retaining bead portion, said block formed from two identical halves, each half including one of said side walls and a half of said upper and lower mortar receiving surfaces and a half of said rear mortar receiving end wall, and means joining said identical two halves including a seam which forms the juncture of the said two identical halves, said seam running centrally along the upper and lower mortar receiving surfaces as well as centrally along the rear mortar receiving end wall, with a seam running centrally along a front end wall with said front end wall extending between the said nonparallel second wall portions.

2. A translucent glass block as set forth in claim 1 wherein, said front end wall is positioned between said pair of side wall nonparallel second wall portions in spaced, parallel relation with said rear end wall, said front end wall being joined to said upper and lower surfaces and to said pair of side wall nonparallel second wall portions.

3. A translucent glass end block as set forth in claim 2 in which, said rear end wall is perpendicular to said pair of upper and lower surfaces.

4. A translucent glass end block as set forth in claim 1 in which, said upper surface and said lower surface of said end block are each arranged to be joined in abutting relationship with an abutting surface of another end block in which said abutting surface of said other end block has a surface configuration corresponding to the configuration of said upper and lower surfaces.

5. A translucent glass end block as set forth in claim 2 in which, said side wall nonparallel second wall portions converge toward said front end wall by substantially the same preselected angle.

* * * * *